US005374980A

United States Patent [19]

Kubo et al.

[11] Patent Number: 5,374,980

[45] Date of Patent: Dec. 20, 1994

[54] COLOR IMAGE FORMING APPARATUS UTILIZING LIQUID DEVELOPMENT

[75] Inventors: Nobuaki Kubo, Urawa; Yuichi Aoyama, Musasino; Nobuhiko Umezawa, Gyouda, all of Japan

[73] Assignee: Ricoh Company, Ltd., Tokyo, Japan

[21] Appl. No.: 126,983

[22] Filed: Sep. 27, 1993

[30] Foreign Application Priority Data

Sep. 25, 1992 [JP] Japan ..... 4-256179

[51] Int. Cl.[5] ..... G03G 15/10

[52] U.S. Cl. ..... 355/256; 355/327

[58] Field of Search ..... 355/256, 257, 258, 269, 355/270, 326 R, 327

[56] References Cited

U.S. PATENT DOCUMENTS

| | | | |
|---|---|---|---|
| 3,729,311 | 4/1973 | Langdon | 355/247 X |
| 3,900,003 | 8/1975 | Sato et al. | 355/256 X |
| 4,043,658 | 8/1977 | Inoue et al. | 355/256 |
| 4,227,797 | 10/1980 | Tsunoi | 355/256 |
| 4,437,755 | 3/1984 | Sakurayama et al. | 355/256 |
| 4,905,047 | 2/1990 | Ariyama | 355/256 |
| 5,150,161 | 9/1992 | Bujese | 355/256 |
| 5,158,846 | 10/1992 | Bujese | 355/327 X |
| 5,285,244 | 2/1994 | Bujese | 355/256 |

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A color image forming apparatus forms an image having a plurality of colors. It includes a plurality of elongate photoconductive members of a number corresponding to the plurality of colors. The axes of the photoconductive members are arranged on a plane extending by no more than 45° from the vertical direction. A plurality of developing units supply a liquid developer to each of the photoconductive members to develop latent images thereon. A movable transfer belt contacts the photoconductive members so that developed images may be transferred to the transfer belt. A plurality of cleaning portions are positioned for scraping liquid developer from the photoconductive members. The widths of the cleaning portions progressively increase from the highest to the lowest. An open topped casing is disposed below each of the photoconductive members for catching liquid toner dropping from the photoconductive members.

18 Claims, 4 Drawing Sheets

COLOR IMAGE FORMING APPARATUS UTILIZING LIQUID DEVELOPMENT

BACKGROUND OF THE INVENTION

1. Field of the Invention

The present invention relates to a color image forming apparatus having a plurality of photoconductive members wherein each of plural latent images is formed on a surface of a separate photoconductive member and is developed by utilizing liquid development for each of the color images.

2. Description of the Related Art

In a conventional color image forming apparatus, it is known that each latent image, which is developed by utilizing dry developer or liquid developer, is formed on the surface of a separate photoconductive member in accordance with information of each color resolution. The developed images are transferred onto a transfer sheet and fixed by a pair of fixing rollers. Toner for liquid development (WET-TYPE) has an advantage of producing a high quality copied image, since toner particles for liquid development are much smaller than those for dry development and since toner for liquid development has excellent transparency characteristics and produces fine image resolution. However, the liquid development, which has different characteristics than does dry developer, is difficult to use due to its fluidity, viscosity, etc., and such a color image forming apparatus using a plurality of color developers has many difficult problems.

An example of a color development system wherein a plurality of developing units are disposed below a drum type photoconductive member and the developing units are moved for developing each color image on the photoconductive member corresponding to each color resolution is disclosed in Japanese Laid-Open Publication No. 55-12758. In addition, in another example of a color development system, a color image forming apparatus uses a four color developer (yellow, cyan, magenta and black) having two developing units, wherein two color images are developed by each unit. Moreover, while one developing unit develops one color image, the developer in another developing unit is exchanged and the developing unit is cleaned. This is disclosed in Japanese Laid-Open Publication No. 3-186870.

In the prior art disclosed in Japanese Laid-Open Publication No. 55-127580, the liquid developer is liable to adhere to the photoconductive member portion where the liquid developer is not necessary, due to its fluidity and viscosity. This contaminates a transfer portion so that after transferring, the liquid developer gets mixed with other developer in the developing units disposed below the drum type photoconductive member. Such mixing causes a color mixture problem.

In order to prevent such problems, there is required an extra device or a complex structure, such as a device for preventing the liquid developer adhering to the photoconductive member portion where a developer is not necessary, a device for removal of the developer for cleaning or a device for reusing the developer for cleaning. The extra device or the complex structure increases the cost of the apparatus.

In the prior art disclosed in Japanese Laid-Open Publication No. 3-186870, it is difficult to avoid the color mixture problem and there is a limitation of image forming speed because two color images are developed by one developer unit.

SUMMARY OF THE INVENTION

It is, therefore, an object of the present invention to provide a color image forming apparatus in which the above-mentioned conventional shortcomings are eliminated. More specifically, it is an object of the present invention to provide a color image forming apparatus having a plurality of photoconductive members arranged on the same plane and each corresponding to a color, and a casing with top opening which is provided below each photoconductive member, wherein one of latent images is formed on each of the photoconductive members by electrophotography and then a transfer sheet is transported to the transfer portion by a transfer belt, and the developed images on each of the photoconductive members is transferred to the transfer sheet.

It is another object of the present invention to provide a color image forming apparatus in which operation timing of each development roller and/or timing of each developer replenisher are/is staggered in turn.

It is another object of the present invention to provide a color image forming apparatus in which the widths of the photoconductive members and of cleaning portions disposed around the photoconductive members are greater than that of a transfer sheet, and the widths of the cleaning portions are different in accordance with vertical positions of the cleaning portions.

It is a further object of the present invention to provide a color image forming apparatus, in which the widths of the photoconductive members and of the cleaning portions disposed around the photoconductive members are greater than that of a transfer sheet, and the widths of the photoconductive members are different in accordance with vertical positions of the photoconductive members.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
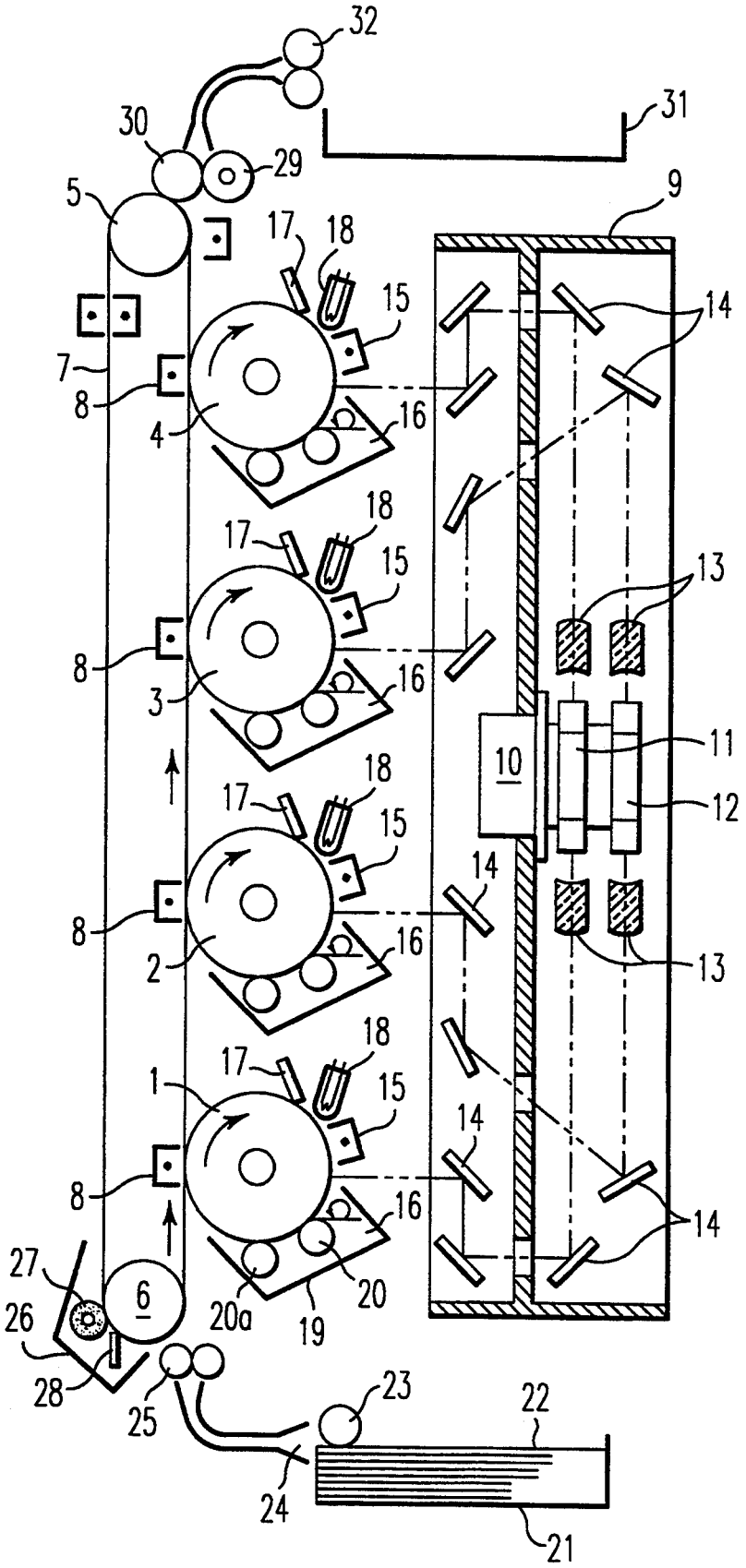
FIG. 1 is a sectional front elevational view showing a color image forming apparatus embodying the present invention.

A preferred embodiment of the present invention will hereinafter be described with reference to the drawings. FIG. 1 is a sectional front elevation view showing a color image forming apparatus embodying the present invention.

In the illustrated color image forming apparatus, there are formed a plurality of elongate photoconductive members 1, 2, 3 and 4, in which each color image is formed on a respective photoconductive member. The photoconductive member 1 is for the black toner image, the photoconductive member 2 is for the cyan toner image, the photoconductive member 3 is for the magenta toner image and the photoconductive member 4 is for the yellow toner image. The longitudinal axes of the photoconductive members 1 through 4 are arranged on substantially the same plane extending in the vertical direction—or a direction inclined by up to 45 degrees from the vertical direction. As can be seen from FIG. 1, for each of the elongate photoconductive members 2–4, a vertical plane passing through the longitudinal axis therefore intersects the elongate photoconductive member located immediately therebelow. The photoconductive members 1 through 4 are provided adjacent a transfer belt 7 and contact therewith. The transfer belt 7 is entrained on a driving roller 5 and a follower roller 6, in which the driving roller 5 and the follower roller 6 are respectively rotatably supported so as to be spaced from one another in a vertical plane parallel to that of the axes of the photoconductive members. The transfer belt 7 is made from a dielectric material such as polyethyleneterephthalate and is an endless belt which is polarized by transfer chargers 8 and electrostatically attracts a transfer sheet. A plurality of the transfer chargers 8 are provided to face to the photoconductive members 1 through 4 via the transfer belt 7.

An elongate exposure device 9 having writing portions arranged corresponding to each photoconductive member is provided to the right of the photoconductive members 1 through 4. In the exposure device 9, light beam signals corresponding to image information depending on color resolution by a scanner are outputted by a laser beam scanning device (not shown) and polygon mirrors 11 and 12 driven by a motor 10 rotate so as to scan the laser beam onto the photoconductive members 1 through 4. A correcting lens 13 for converging the laser beam and mirrors 14 for deviating the laser beam are disposed in each optical path.

At the circumference of each of the photoconductive members 1, 2, 3 and 4 are disposed respective chargers 15 for charging, developing units 16 for liquid development, cleaning blades 17 as a cleaning portion and discharging lamps 18. Taking the axial center of each of the photoconductive members 1 through 4 as the origin of a two dimensional coordinates axis on the plane of FIG. 1, the charger 15 for charging, the cleaning blade 17 and the discharging lamp 18 are located at the first (upper right) quadrant and the developing units 16 for liquid development are located at the third (lower right) quadrant and the fourth (lower left) quadrant.

Figure 2:
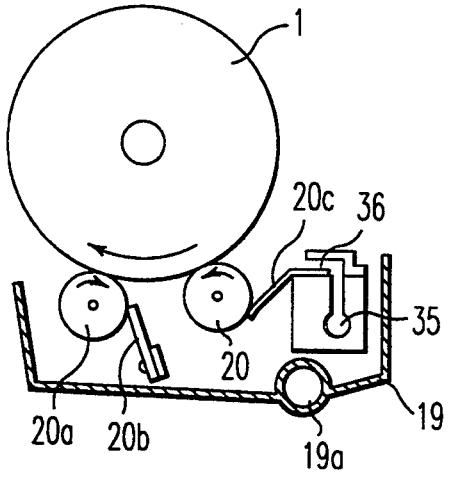
FIG. 2 is a schematic view showing a development portion of the color image forming apparatus embodying the present invention.
Figure 4:
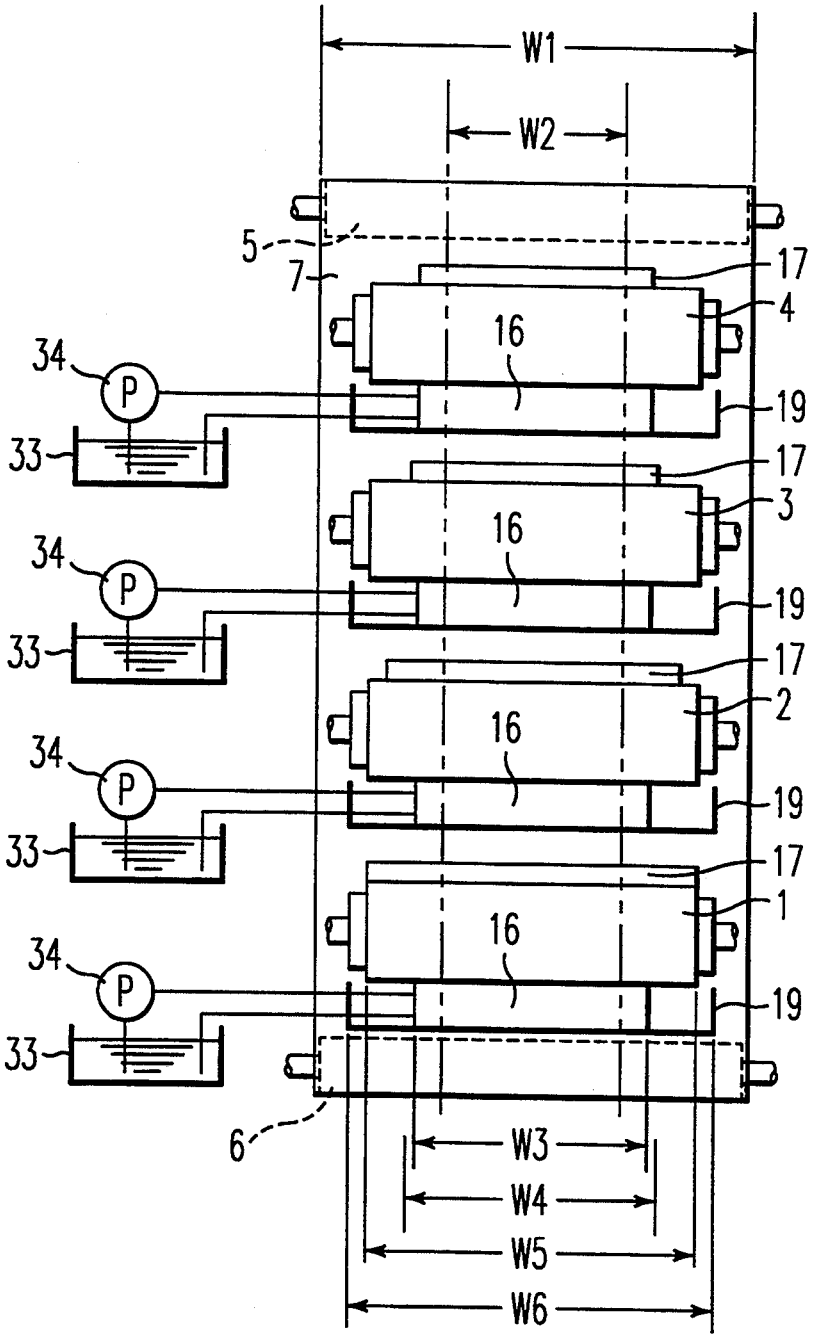
FIG. 4 is a side elevational view showing other color image forming apparatus embodying the present invention.

Each of the developing units 16 provided below a respective photoconductive member comprises a casing 19 with an open top, a developing roller 20 and a reverse roller **20*a*. FIG. 2 shows more detail of the developing units 16. Each of the developing units 16 also includes a developer supply hole 35 wherein the liquid developer is supplied from a developer tank 33 by a supply pump 34 (as shown in FIG. 4). The developer flows from a supply nozzle portion 36 to a guiding film 20*c* touching the surface of the developing roller 20. The developing roller 20 rotates in the counterclockwise direction so as to supply the developer to a gap portion (about 150 μm) between the photoconductive member 1 and the developer roller 20**.

A scraper blade **20*b* is held against the reverse roller 20*a* and a gap of about 50 μm is formed between the photoconductive member 1 and the reverse roller 20*a*. The reverse roller 20*a* rotates in the clockwise direction so as to scrape excess developer from the photoconductive member and form a uniform thickness of the developer film. The scraper blade 20*b* scrapes toner from the reverse roller 20*a* and the scraped toner in the casing 19 is circulated through a retrieval hole 19*a*** and a retrieval pipe.

Below the photoconductive member 1, a feed roller 23 feeds transfer sheets 22 from a sheet supplying cassette 21 designed to hold transfer sheets of a predetermined width. The transfer sheets 22 are guided by a feeding path 24 and hold rollers 25, and are fed to the transfer belt 7. A cleaning unit 26 for supplying cleaning liquid is disposed around the follower roller 6 via the transfer belt 7. The cleaning unit 26 comprises a cleaning foam roller 27 contacting the transfer belt 7 and a cleaning blade 28 also contacting the transfer belt 7. A fixing roller 29 and a press roller 30 in contact with each other are pivotally provided above the driving roller 5. Discharging rollers 32 discharge the transfer sheet 22 passing the fixing roller 29 onto a discharge tray 31.

In the above-described construction, one of the color images is formed on each of the photoconductive member 1, 2, 3 and 4. Hereafter, an image forming process using the photoconductive member 1 will be described and detailed explanations of the image forming process concerning the other photoconductive members are omitted because they are substantially the same as that of the photoconductive member 1.

The photoconductive member 1 is rotated about its own axis in the direction of the arrow by a drive device (not shown) and is uniformly charged by the charger 15. The image information for the black color is modulated to a semiconductor laser device (not shown). The laser beams therefrom are deviated by the rotating polygon mirror 11 and form an electrostatic latent image on the photoconductive member 1. The electrostatic latent image is developed into a black toner image by the developing roller 20, wherein a predetermined bias voltage/current is applied to the developing roller 20 in the developing unit 16 for black developer so as that toner in the liquid developer is adhered to the latent image on the photoconductive member 1 by electrophoresis.

On the other hand, the tip portion of the transfer sheet 22 fed by the feed roller 23 is held at the nip portion of the hold rollers 25 so as to position it with respect with the toner image on the photoconductive member 1, and the transfer sheet 22 is fed by the rotation of the hold rollers 25 and the transfer belt 7, both of which are synchronized with the rotation of the photoconductive member 1. The black toner image on the photoconductive member 1 is transferred onto the transfer sheet 22 by the lowermost transfer charger 8. In the same way, the latent image for cyan toner is formed on the surface of the photoconductive member 2 and developed by the cyan developer, and a cyan toner image on the photoconductive member 2 is transferred onto the transfer sheet 22. Next, the latent image for magenta toner is formed on the surface of the photoconductive member 3 and developed by the magenta developer, and a magenta toner image on the photoconductive member 3 is transferred onto the transfer sheet 22. Furthermore, the latent image for yellow toner is formed on the surface of the photoconductive member 4 and developed by the yellow developer, and a yellow toner image on the photoconductive member 4 is transferred onto the transfer sheet 22. The final color image is thus formed on the transfer sheet 22.

A bias current/voltage applied to each transfer charger 8 corresponding to the photoconductive members 1 through 4 is raised gradually in accordance with the order of transferring in order to execute good transferring. For example, the bias currents of the transfer chargers 8 for the photoconductive members 1, 2, 3 and 4 are 300 μA, 500 μA, 700 μA and 1000 μA respectively.

The image transferred sheet 22 is then separated from the transfer belt 7, transported past the fixing roller 29 and the pressing roller 30 to fix the image, and driven out onto the discharge tray 31. The transfer belt 7 is cleaned by the cleaning foam roller 27 so as to remove the remaining developer thereon after the each image transfer.

The remaining developer on each photoconductive member is liable to flow along the surface of the photoconductive member and drop from it, especially if the photoconductive member is stopped and excess developer is supplied. In addition, the developer scraped by the cleaning blade 17 when the width of the cleaning blade 17 is greater than that of the photoconductive member, drops therefrom at the axial ends of the photoconductive member.

However, the developer dropping from each photoconductive member is effectively caught by the casing 19 of the developing unit 16. For this purpose, the width of the casing 19 is greater than that of the corresponding photoconductive member. Each of the casings 19 prevents the excess developer on the corresponding photoconductive member or developing unit, which is located thereabove, from dropping on the photoconductive member or the developing unit which is located below the respective casing.

In the color image forming apparatus having the above construction, the color mixing problem does not occur and high speed image forming is accomplished because each of the developing units 16 corresponds to only one of the photoconductive members 1 through 4 and so these units 16 need not exchange developer. Moreover, the axes of the photoconductive members 1 through 4 are arranged on substantially the same plane deviating from the vertical direction by up to 45 degrees, and the transfer belt 7 is also vertically disposed (plus or minus 45 degrees) in its longitudinal direction. Therefore, a minimum of space is required for installation.

Figure 3:
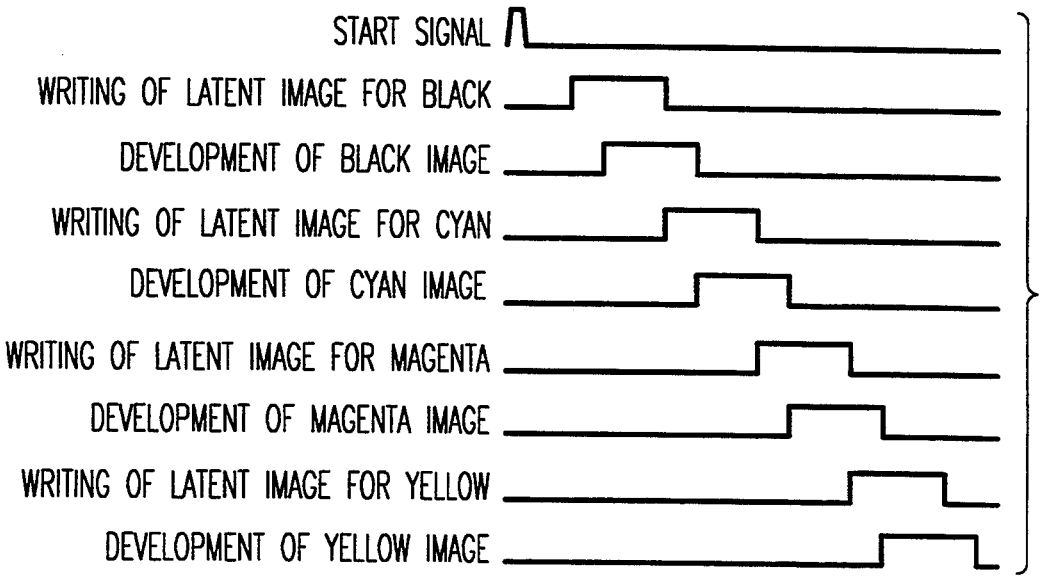
FIG. 3 is a timing chart for a possible operational sequence for the color image forming apparatus embodying the present invention.

A further sequence of operation of the present invention will hereinafter be described with reference to FIG. 3. This sequence is applicable to the above described embodiment and is directed only to the supply timing of each developer. Therefore, a detailed explanation of the image forming apparatus is omitted to avoid repetition.

In a conventional color image forming apparatus utilizing dry developer, a plurality of photoconductive members and developing units are simultaneously put into operation by a start signal, and the timing of each latent image written on each photoconductive member is staggered in turn. In this case, it is not necessary that the operation timing of applying a bias voltage on each developing unit is staggered in turn, because dry toner in a developing unit does not adhere on the surface of the photoconductive member when the latent image is not formed on it. But, in a color image forming apparatus utilizing liquid developer, toner particles are dispersed in a carrier material and moved in the carrier material by electrophoresis. The carrier material is made from an aliphatic hydrocarbon, for example. Isoper which is a Trademark of the Exxon Corporation.) Some liquid developer supplied on the developing roller 20 adheres on each surface of the photoconductive members 1 through 4 and the transfer belt 7 even if the latent image is not formed on it. Therefore, when a plurality of photoconductive members and developing units are simultaneously put into operation, the extra developer which does not contribute to forming a toner image is supplied and the developer consumption increases.

In this embodiment having a developing unit 16 around each of the photoconductive members 1 through 4, operation timing of the development roller 20 in each developing unit 16 is set up to be staggered in turn, i.e. sequential with respect to the first photoconductive member 1. For example, as shown in FIG. 3, after receiving the start signal for image forming, a latent image corresponding to black toner is written by the exposure device 9 and the electrostatic latent image is developed into a black toner image by the developing roller 20 for supplying black liquid developer. Next, the latent image for cyan toner is formed on the surface of the photoconductive member 2 and the electrostatic latent image is developed into a cyan toner image by the developing roller for supplying cyan liquid developer. Next, the latent image for magenta toner is formed on the surface of the photoconductive member 2 and the electrostatic latent image is developed into a magenta toner image by the developing roller for supplying magenta liquid developer. Finally, the latent image for yellow toner is formed on the surface of the photoconductive member 2 and the electrostatic latent image is developed into a yellow toner image by the developing roller for supplying yellow liquid developer.

In addition, operation timing of each developer replenisher is set up to be staggered in turn with respect to the first developing unit 16 for the photoconductive member 1 in order to reduce the carrier material adhering to each photoconductive member and the transfer belt 7. Timing of each developer replenisher, corresponding to timing of each latent image forming, to each photoconductive member or to each developing roller, is controlled by the pump for supplying developer or by rotating control of the developer roller 16. As a result, the developer consumption reduces.

Another embodiment of the present invention will hereinafter be described with reference to FIG. 4, wherein like reference numerals designate identical or corresponding parts. This embodiment is the same construction as the first described embodiment except for the width of a cleaning blade. Therefore, detailed explanation of the image forming apparatus is omitted to avoid repetition.

FIG. 4 shows a side view of the color image forming apparatus according to this embodiment. The widths of the photoconductive members and that of the cleaning blade 17 which is disposed around each photoconductive member is greater in axial the direction than that of the transfer sheet 22, and each such widths of the cleaning blades 17 is different in accordance with the vertical position of the cleaning portion, i.e., said widths of the cleaning blades 17 progressively increase from the highest cleaning blade to the lowest cleaning blade. A developing area of the developing unit 16 is greater than the width of the transfer paper 22, and the width of the casing 19 of the developing unit 16 in the axial direction is greater than the width of the photoconductive members 1 through 4 in the axial direction. The developer is supplied from the developer tank 33 to each developing unit 16 by the pump 34. In FIG. 4, W1 indicates the width of the transfer belt, W2 indicates the width of the transfer sheet, W3 indicates the width of the developing area, W4 indicates the minimum width of the cleaning blades, W5 indicates the maximum width of the cleaning blades and W6 indicates the width of the casing of the developing unit.

Some toner and carrier material remain on the photoconductive members 1 through 4 after the developed images on the photoconductive members 1 through 4 are transferred to the transfer sheet 22. It is necessary that the remaining developer on the photoconductive members 1 through 4 is scraped therefrom. The developer scraped by the cleaning blade 17 flows down from both ends of the cleaning blade 17 to the axial ends of the photoconductive members 1 through 4 and there gathers in a ring shape called a "liquid ring". The gathered developer on the photoconductive members 1 through 4 can undesirably adhere to the back surface of the transfer belt 7 and cause it to slip. Therefore, the widths of the cleaning blades 17 in the scanning direction progressively increases from the highest cleaning blade to the lowest blade so as that an adhering distribution of the developer which flows down from the ends of the cleaning blade 17 to the axial ends of the photoconductive members 1 through 4, and adheres to the developing belt 7, is dispersed. As a result, the phenomenon that the quantity of developer on the transfer belt 7 is sufficient that the developer is transported from the front surface to the back surface thereof is restrained and the transfer belt 7 slipping on the driving roller 5 is prevented.

The accurate transport of the transfer sheet 22 is thus accomplished.

A further embodiment of the present invention will now be described with reference to FIG. 5, wherein like reference numerals designate identical or corresponding parts.

This embodiment is the same construction as the first described embodiment except for the widths of the cleaning blade and photoconductive members. Therefore, a detailed explanation of the image forming apparatus is omitted to avoid repetition.

Figure 5:
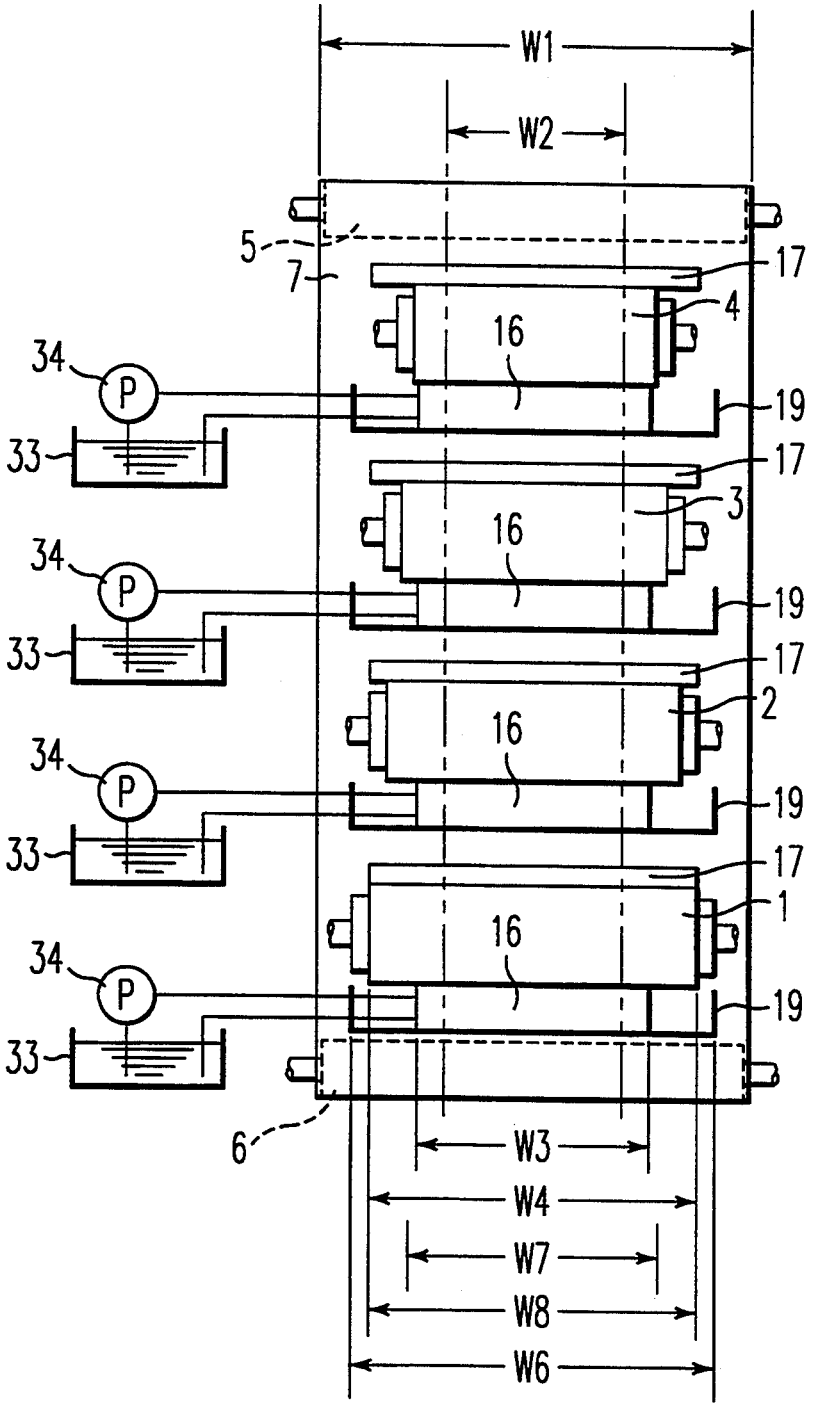
FIG. 5 is a side elevational view showing yet a further color image apparatus embodying the present invention.

FIG. 5 shows a side view of a further color image forming apparatus according to this embodiment. The widths of the photoconductive members 1 through 4 and that of cleaning blades 17 which are disposed around each photoconductive member, is greater in the axial direction than that of the transfer sheet 22, and each width of the photoconductive members in said direction is different in accordance with the vertical positions of the photoconductive members; i.e., the widths of the photoconductive members 1 through 4 increase one after another from the photoconductive member 4 located in the highest position to the photoconductive member 1 located in the lowest position. The widths of the casings 19 in the developing unit 16 in said direction is greater than that of the photoconductive members 1 through 4 in said direction. In FIG. 5, W1 indicates the width of the transfer belt, W2 indicates the width of the transfer sheet, W3 indicates the width of the developing area, W4 indicates the width of the cleaning blade, W6 indicates the width of the casing of the developing unit, W7 indicates the minimum width of the photoconductive member and W8 indicates the maximum width of the photoconductive member.

In this construction, the developer on the photoconductive members 1 through 4 is scraped by each cleaning blade 17. The developer dropping from the photoconductive members 1 through 4 is almost entirely caught by each casing 19 having a broad area. Some developer on the photoconductive members 1 through 4 adheres to the transfer belt 7. However an adhering distribution of the developer which adheres to the transfer belt 7 is dispersed by using the different width photoconductive members in the axial direction. As a result, the phenomenon that the developer on the transfer belt 7 is transported from the front surface to the back surface thereof is restrained and the transfer belt 7 slipping on the driving roller 5 is prevented. The accurate transport of the transfer sheet 22 is thus accomplished.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A color image forming apparatus for forming an image of a plurality of colors, said apparatus comprising:

a plurality of elongate photoconductive members of a number corresponding to the plurality of colors, said photoconductive members having longitudinal axes arranged on a plane extending by no more than 45° from the vertical direction, wherein, for each of said elongate photoconductive members, a vertical plane passing through the longitudinal axis thereof intersects the elongate photoconductive member located immediately therebelow;

a plurality of developing units for supplying a liquid developer to each of said photoconductive members to develop latent images thereon;

a movable transfer belt contacting with said photoconductive members, wherein the developed images may be transferred to said transfer belt;

a plurality of cleaning portions positioned for scraping liquid developer from said photoconductive members; and an open topped casing disposed below each of said photoconductive members for catching liquid toner dropping from said photoconductive members, an axial width of each of said casings being greater than that of a corresponding one of said photoconductive members.

2. The apparatus of claim 1, including a plurality of transfer chargers positioned in proximity to said plurality of photoconductive members for transferring developed images from said photoconductive members to said transfer belt, said transfer chargers providing progressively increasing charges in a direction of movement of said transfer belt.

3. The apparatus of claim 1, including an elongate exposure device having writing portions arranged to correspond to said photoconductive members.

4. The apparatus of claim 1 wherein said plane extends substantially vertically.

5. A color image forming apparatus for forming an image of a plurality of colors, said apparatus comprising:

a plurality of elongate photoconductive members of a number corresponding to the plurality of colors, said photoconductive members having longitudinal axes arranged on a plane extending by no more than 45° from the vertical direction, wherein, for each of said elongate photoconductive members, a vertical plane passing through the longitudinal axis thereof intersects the elongate photoconductive member located immediately therebelow;

a plurality of developing units for supplying a liquid developer to each of said photoconductive members to develop latent images thereon, wherein said developing units operate sequentially;

a movable transfer belt contacting with said photoconductive members, wherein the developed images may be transferred to said transfer belt;

a plurality of cleaning portions positioned for scraping liquid developer from said photoconductive members; and an open topped casing disposed below each of said photoconductive members for catching liquid toner dropping from said photoconductive members, an axial width of each of said casings being greater than that of a corresponding one of said photoconductive members.

6. The apparatus of claim 2, wherein each of said developing units includes a developing roller, the developing rollers of the respective developing units operating sequentially.

7. The apparatus of claim 5, including a plurality of transfer charges positioned in proximity to said plurality of photoconductive members for transferring developed images from said photoconductive members to said transfer belt, said transfer chargers providing progressively increasing charges in a direction of movement of said transfer belt.

8. The apparatus of claim 5, including an elongate exposure device having writing portions arranged to correspond to said photoconductive members.

9. The apparatus of claim 5 wherein said plane extends substantially vertically.

10. A color image forming apparatus for forming an image of a plurality of colors, said apparatus comprising:

a plurality of elongate photoconductive members of a number corresponding to the plurality of colors, said photoconductive members having longitudinal axes arranged on a plane extending by no more than 45° from the vertical direction, wherein, for each of said elongate photoconductive members, a vertical plane passing through the longitudinal axis thereof intersects the elongate photoconductive member located immediately therebelow;

a plurality of developing units for supplying a liquid developer to each of said photoconductive members to develop latent images thereon, wherein said developing units operate sequentially;

a movable transfer belt contacting with said photoconductive members, wherein the developed images may be transferred to said transfer belt;

a plurality of cleaning portions positioned for scraping liquid developer from said photoconductive members; and an open topped casing disposed below each of said photoconductive members for catching liquid toner dropping from said photoconductive members, an axial width of each of said casings being greater than that of a corresponding one of said photoconductive members, wherein each of said developing units includes a developer replenisher and wherein said developer replenishers operate sequentially and in an order corresponding to an order of operation of said developing units.

11. The apparatus of claim 10, wherein each of said developing units includes a developing roller, the developing rollers of the respective developing units operating sequentially.

12. The apparatus of claim 10, including a plurality of transfer chargers positioned in proximity to said plurality of photoconductive members for transferring developed images from said photoconductive members to said transfer belt, said transfer chargers providing progressively increasing charges in a direction of movement of said transfer belt.

13. The apparatus of claim 10, including an elongate exposure device having writing portions arranged to correspond to said photoconductive members.

14. The apparatus of claim 10 wherein said plane extends substantially vertically.

15. A color image forming apparatus for forming an image of a plurality of colors, said apparatus comprising:

a plurality of elongate photoconductive members of a number corresponding to the plurality of colors, said photoconductive members having longitudinal axes arranged on a plane extending by no more than 45° from the vertical direction;

a plurality of developing units for supplying a liquid developer to each of said photoconductive members to develop latent images thereon;

a movable transfer belt contacting with said photoconductive members, wherein the developed images may be transferred to said transfer belt;

a plurality of cleaning portions positioned for scraping liquid developer from said photoconductive members;

an open topped casing disposed below each of said photoconductive members for catching liquid toner dropping from said photoconductive members; and means for holding transfer sheets having a width, wherein the width of all of the photoconductive members in the axial direction and the width of all of the cleaning portions in the axial direction is greater than the width of the transfer sheets, and wherein the widths of the cleaning portions in the axial direction progressively increases from a highest one of said cleaning portions to a lowest one of said cleaning portions.

16. A color image forming apparatus for forming an image of a plurality of colors, said apparatus comprising:

a plurality of elongate photoconductive members of a number corresponding to the plurality of colors, said photoconductive members having longitudinal axes arranged on a plane extending by no more than 45° from the vertical direction;

a plurality of developing units for supplying a liquid developer to each of said photoconductive members to develop latent images thereon, wherein said developing units operate sequentially;

a movable transfer belt contacting with said photoconductive members, wherein the developed images may be transferred to said transfer belt;

a plurality of cleaning portions positioned for scraping liquid developer from said photoconductive members;

an open topped casing disposed below each of said photoconductive members for catching liquid toner dropping from said photoconductive members; and means for holding transfer sheets having a width, wherein the width of all of the photoconductive members in the axial direction and the width of all of the cleaning portions in the axial direction is greater than the width of the transfer sheets, and wherein the widths of the cleaning portions in the axial direction progressively increases from a highest one of said cleaning portions to a lowest one of said cleaning portions.

17. A color image forming apparatus for forming an image of a plurality of colors, said apparatus comprising:

a plurality of elongate photoconductive members of a number corresponding to the plurality of colors, said photoconductive members having longitudinal axes arranged on a plane extending by no more than 45° from the vertical direction;

a plurality of developing units for supplying a liquid developer to each of said photoconductive members to develop latent images thereon;

a movable transfer belt contacting with said photoconductive members, wherein the developed images may be transferred to said transfer belt;

a plurality of cleaning portions positioned for scraping liquid developer from said photoconductive members;

an open topped casing disposed below each of said photoconductive members for catching liquid toner dropping from said photoconductive members; and means for holding transfer sheets having a width, wherein the width of all of the photoconductive members in the axial direction and the width of all of the cleaning portions in the axial direction is greater than the width of the transfer sheets, and wherein the widths of the photoconductive members in the axial direction progressively increases from a highest one of said photoconductive members to a lowest one of said photoconductive members.

18. A color image forming apparatus for forming an image of a plurality of colors, said apparatus comprising:

a plurality of elongate photoconductive members of a number corresponding to the plurality of colors, said photoconductive members having longitudinal axes arranged on a plane extending by no more than 45° from the vertical direction;

a plurality of developing units for supplying a liquid developer to each of said photoconductive members to develop latent images thereon, wherein said developing units operate sequentially;

a movable transfer belt contacting with said photoconductive members, wherein the developed images may be transferred to said transfer belt;

a plurality of cleaning portions positioned for scraping liquid developer from said photoconductive members;

an open topped casing disposed below each of said photoconductive members for catching liquid toner dropping from said photoconductive members; and means for holding transfer sheets having a width, wherein the width of all of the photoconductive members in the axial direction and the width of all of the cleaning portions in the axial direction is greater than the width of the transfer sheets, and wherein the widths of the photoconductive members in the axial direction progressively increases from a highest one of said photoconductive members to a lowest one of said cleaning portions.

* * * * *